US007323082B2

(12) United States Patent
Morandi

(10) Patent No.: US 7,323,082 B2
(45) Date of Patent: Jan. 29, 2008

(54) METHOD AND APPARATUS FOR FORMING SUBSTANTIALLY PLATE-LIKE CERAMIC ARTICLES

(75) Inventor: Eugenio Morandi, Sassuolo (IT)

(73) Assignee: Officine Morandi S.r.L., Sassuolo (IT)

( * ) Notice: Subject to any disclaimer, the term of this patent is extended or adjusted under 35 U.S.C. 154(b) by 483 days.

(21) Appl. No.: 10/857,832

(22) Filed: Jun. 2, 2004

(65) Prior Publication Data

US 2004/0251582 A1 Dec. 16, 2004

(30) Foreign Application Priority Data

Jun. 13, 2003 (IT) ..... MO2003A0174

(51) Int. Cl.
*D21F 9/00* (2006.01)
*D21F 9/02* (2006.01)
*B28B 5/02* (2006.01)

(52) U.S. Cl. ..... 162/152; 162/256; 162/286; 425/84

(58) Field of Classification Search ..... 162/208, 162/145, 152–156, 194, 260, 286, 256; 264/651, 264/86, 87; 425/84, 85; 428/703
See application file for complete search history.

(56) References Cited

U.S. PATENT DOCUMENTS

| | | | | |
|---|---|---|---|---|
| 3,371,134 | A * | 2/1968 | Ollinger | 264/641 |
| 4,267,136 | A * | 5/1981 | Bijen | 264/87 |
| 4,383,960 | A * | 5/1983 | Delcoigne et al. | 264/87 |
| 4,917,749 | A * | 4/1990 | Vittone et al. | 156/242 |
| 5,632,848 | A * | 5/1997 | Richards et al. | 156/346 |
| 6,713,015 | B1 * | 3/2004 | Toncelli et al. | 264/660 |

FOREIGN PATENT DOCUMENTS

WO WO 98/46543 A 10/1998

* cited by examiner

*Primary Examiner*—Eric Hug
(74) *Attorney, Agent, or Firm*—Nixon & Vanderhye P.C.

(57) ABSTRACT

A method for forming plate-like ceramic articles, comprising at least one step for deposition by pouring of at least one layer of a ceramic mixture that comprises an aqueous vehicle on a substantially absorbent transfer surface adapted to draw the aqueous vehicle, at least one step for drying so as to obtain a continuous material strand, and a cutting step for cutting the strand into a plurality of ceramic articles. An apparatus for performing the method comprising a framework for supporting an absorbent transfer surface, at least one unit for depositing at least one mixture layer onto the surface, at least one drying unit for at least partial drying of the mixture layer to obtain a continuous strand of plastic ceramic material, and a cutting unit.

20 Claims, 3 Drawing Sheets

METHOD AND APPARATUS FOR FORMING SUBSTANTIALLY PLATE-LIKE CERAMIC ARTICLES

The present invention relates to a method for forming substantially plate-like ceramic articles and to the apparatus for carrying out the method.

BACKGROUND OF THE INVENTION

It is known that various technologies are used in the ceramics sector to manufacture ceramic articles such as tiles and the like and can be distinguished substantially according to the forming method that they use.

Forming by pressing is known, for example, and generally provides for the wet milling of the raw materials in drum mills in order to obtain an aqueous suspension of milled solid particles that is conventionally known as slurry.

The resulting slurry is discharged from the mill and deposited in dedicated tanks, which are provided with means for moving said slurry and in which, in the case of the manufacture of porcelain stoneware articles, it is possible to add appropriately milled coloring oxides in order to obtain slurries having various colors.

The slurry is then dried inside spray driers in order to obtain powders that have a controlled degree of humidity, which are fed toward the article forming presses after a settling and homogenization step.

As an alternative, it is also known to form articles by extrusion; this method uses slurries that are first filtered within appropriately provided filter presses in order to obtain a plastic paste.

Said plastic paste is then extruded through dies, from which it exits as a continuous strand to be cut into articles having the chosen dimensions.

Regardless of whether forming has occurred by pressing or by extrusion, the resulting articles are fired in a kiln, after optional surface decoration and/or glazing.

However, these known methods are not free from drawbacks, including the fact that the slurries discharged from the mills must be subjected to an intermediate treatment (drying or filtering) performed before forming the articles, and said treatment requires the availability of dedicated equipment and entails structural complications of the production facilities, an increase in the installation and running costs of said facilities, an increased length and reduced speed of production lines, and an increase in labor costs and energy consumption.

Moreover, particularly in the case of forming porcelain stoneware articles by pressing, managing powders in different colors, formats and/or particle sizes is rather complicated and expensive.

To obviate these drawbacks, a method for forming ceramic articles is also known which essentially consists in depositing in succession on a porous working surface a plurality of uniform layers of a fluid mixture of ceramic material, each layer being deposited on the previous one after drying the latter by heating it.

In particular, the drying step consists in transferring heat by convection and/or radiation to the intermediate component being produced, so as to achieve evaporation of the moisture contained in the freshly deposited layer.

However, even this known method is susceptible of further improvements aimed in particular at reducing the operating temperatures, in order to avoid the formation of defects in the resulting articles caused by expansion of air microbubbles retained in the deposited layers and/or by the boiling of the water contained inside the intermediate components being processed, and to contain energy consumption.

SUMMARY OF THE INVENTION

The aim of the present invention is to provide a method and apparatus for forming, at reduced temperatures, and anyway such as to avoid formation of defects, substantially plate-like ceramic articles.

Within this aim, an object of the present invention is to provide a method that is simple, relatively easy to provide in practice, safe in use, effective in operation, and has a relatively low cost.

This aim and this and other objects that will become better apparent hereinafter are achieved by the present method for forming substantially plate-like ceramic articles, characterized in that it comprises at least one step for deposition by pouring of at least one layer of a ceramic mixture that comprises an aqueous vehicle on a substantially absorbent transfer surface suitable to draw said aqueous vehicle, at least one step for drying at least the lower portion of said surface so as to achieve at least partial evaporation of the aqueous vehicle absorbed by said surface, with consequent at least partial drying of said layer in order to obtain a continuous strand of plastic ceramic material, and a step for cutting said strand into a plurality of ceramic articles.

This aim and this and other objects that will become better apparent hereinafter are further achieved by an apparatus for performing the method according to the invention, characterized in that it comprises a framework for supporting a substantially absorbent transfer surface, at least one unit for depositing, by pouring onto said surface, at least one layer of a ceramic mixture that comprises an aqueous vehicle, at least one unit for drying at least the lower portion of said surface so as to achieve at least partial evaporation of the aqueous vehicle absorbed by said surface, with consequent at least partial drying of said layer in order to obtain a continuous strand of plastic ceramic material, and a unit for cutting said strand into a plurality of ceramic articles.

BRIEF DESCRIPTION OF THE DRAWINGS

Further characteristics and advantages of the present invention will become better apparent from the following detailed description of some preferred but not exclusive embodiments of a method for forming substantially plate-like ceramic articles and of the associated apparatus, illustrated by way of non-limiting example in the accompanying drawings, wherein.

DESCRIPTION OF THE PREFERRED EMBODIMENTS

Figure 1:
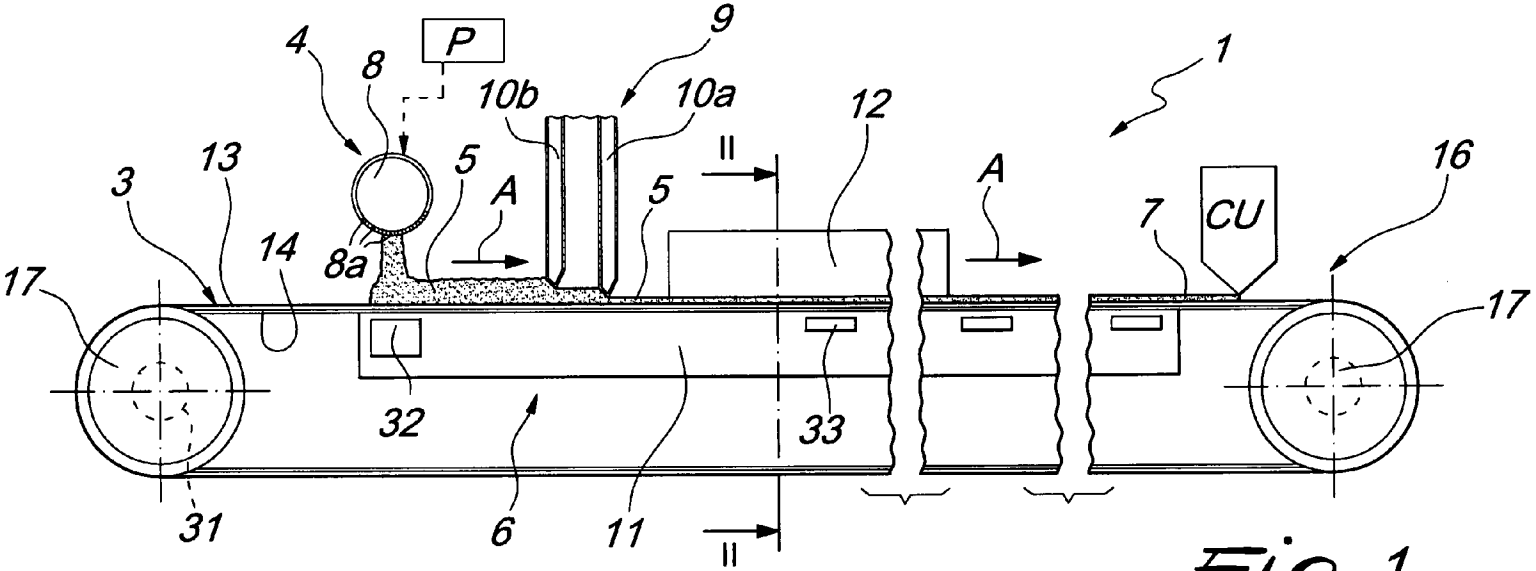
FIG. 1 is a schematic partial side view of a first embodiment of the apparatus for performing the method according to the invention.
Figure 2:
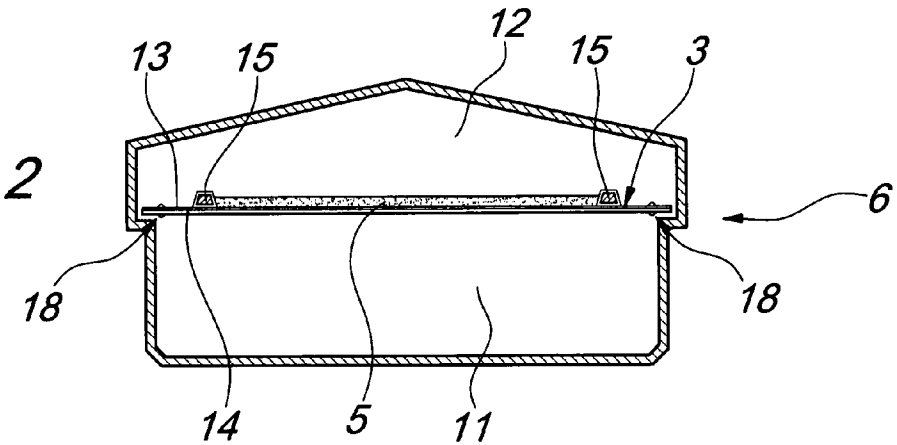
FIG. 2 is a sectional view, taken along the line II-II of FIG. 1.

With reference to the figures, the reference numeral 1 generally designates an apparatus for forming substantially plate-like or plate-shaped ceramic articles, particularly tiles and the like.

The apparatus 1 comprises a framework 2 for supporting a horizontal surface 3 for transfer along an advancement direction, designated by the arrows A in the figures, which is of a substantially absorbent type, at least one unit 4 for depositing by pouring a layer 5 of a ceramic mixture that comprises an aqueous vehicle on the surface 3, and at least one unit 6 for drying the lower portion of the surface 3 so as to achieve at least partial evaporation of the aqueous vehicle absorbed by said surface, with consequent at least partial drying of the layer 5, in order to obtain a continuous strand 7 of plastic ceramic material.

The apparatus 1 further comprises, downstream of the drying unit 6, a conventional cutting unit CU for cutting the strand 7 into a plurality of ceramic articles such as tiles or the like.

Such cutting unit CU can be provided directly on the surface 3 or on an auxiliary working surface not shown in the figures.

In this last case it is possible to provide means for the automatic transfer of portions of the strand 7 from the surface 3 to the auxiliary surface.

As an alternative, the cutting unit CU can have pre-cutting means on the surface 3 and means for finishing the cutting process on the auxiliary surface.

The ceramic mixture that is used is constituted for example by a conventional slurry, which comprises an aqueous suspension of ceramic raw materials in powder form, obtained according to the conventional operating method.

In the illustrated embodiments, the apparatus 1 has a deposition unit 4 and a drying unit 6, which is arranged on the surface 3 downstream of said deposition unit along the advancement direction A; the strand 7 is formed starting from a single layer 5.

However, alternative embodiments of the apparatus 1 are also possible in which there are a plurality of units 4 for depositing respective layers 5, the first mixture layer 5 being deposited on the surface 3 and each successive layer 5 being superimposed on the previously deposited layer 5.

In this case, the strand 7 is formed starting from a plurality of mutually superimposed layers 5 constituted by respective ceramic mixtures, which may optionally be different from one another.

The apparatus 1 may have a single drying unit 6, which runs substantially along the entire length of the surface 3, or a plurality of drying units 6, which are distributed along said surface and cooperate with respective deposition units 4.

The drying of the surface 3 reduces the content of aqueous vehicle retained by the porosities of said surface, so that the surface 3 does not reach saturation and continues to draw, by capillary action, the aqueous vehicle from the overlying layer 5, producing a gradual drying of said layer.

The deposition unit 4 comprises a tubular body 8, which is arranged above the surface 3 and transversely to the advancement direction A and has, in a lower region, a plurality of holes 8*a* for dispensing the ceramic mixture, and a pump P for supplying said mixture which is associated with the tubular body 8.

Conveniently, such dispensing holes, not shown in the figures, are distributed along the length of the tubular body 8 with a constant spacing and a width that allow a sufficiently uniform distribution of the ceramic mixture on the surface 3.

As an alternative, the deposition unit 4 may have a conventional hopper or the like.

In a first embodiment, shown in FIG. 1, the apparatus 1 comprises a unit 9 for leveling the layer 5, which is arranged on the surface 3 downstream of the deposition unit 4 along the advancement direction A and comprises at least one leveling blade 10, which is arranged above the surface 3 transversely to said advancement direction.

In the particular embodiment shown, the leveling unit 9 is composed of two leveling blades 10, which are arranged in series on the surface 3 at different distances from said surface.

In particular, the leveling blade 10*a* arranged downstream of the leveling blade 10*b* along the advancement direction A is arranged closer to the surface 3 than the leveling blade 10*b*.

However, alternative embodiments of the invention are also possible in which the leveling blades 10 are arranged for example so that they are equidistant from the surface 3 or in which the first leveling blade 10 encountered by the layer 5 along the advancement direction A is closer to the surface 3 than the subsequent leveling blade or blades 10, so as to compress said layer.

The leveling blades 10 can be associated with means for adjusting their respective working heights with respect to the surface 3.

If the apparatus 1 has a plurality of deposition units 4, it is possible to provide a plurality of leveling units 9 distributed along the surface 3, each unit being arranged downstream of a corresponding deposition unit 4.

The apparatus 1 can be provided with automatic means for removing the tubular body or bodies 8 and the leveling blades 10 in case of maintenance and/or cleaning of the surface 3.

The drying unit 6 comprises ventilation means 32 and optionally comprises heat generation means 33 of the conduction, convection or radiation type, which cooperate with the lower portion of the surface 3.

In a particular embodiment of the apparatus 1, for example, the drying unit 6 has a channel 11, which is arranged below the surface 3 and feeds below said surface an air stream that is generated by said ventilation means and is heated by appropriate heat generation means of a conventional type.

Conveniently, the drying unit 6 has a closed chamber 12 for containing a portion of the surface 3 that is arranged above the surface 3 directly downstream of the deposition unit 4 and of the corresponding leveling unit 9 along the advancement direction A of said surface.

The humidity that evaporates from the surface 3 and accordingly from the layer 5 gradually saturates the atmosphere inside the chamber 12, so as to hinder initially the drying of the upper part of the layer 5, avoiding the formation of defects such as wrinkles or microcracks, at the upper surface of the strand 7, which coincides with the exposed surface of the articles being produced.

Advantageously, the surface 3 comprises at least one first layer 13 of material that absorbs the aqueous vehicle contained in the mixture being used, which forms the surface on which the layer 5 rests and is therefore in contact with it.

Said absorbent material is constituted for example by textile fibers, preferably made of cotton or any other fiber adapted to absorb aqueous substances.

The apparatus 1 further has at least one second layer 14 for supporting the first layer 13, which is arranged below said first layer at least at the drying unit 6 and is made of an air-permeable material.

The material of which the second layer 14 is made is preferably made of a material that has heat-conduction properties, i.e. is of the heat-conducting type.

In a preferred embodiment of the apparatus 1, the second layer 14 is constituted by a metallic mesh of appropriate thickness, so as to support the first layer 13, which is constituted by a plurality of mutually articulated links whose width makes said mesh rigid enough to provide suitable support for the first layer 13 and allow the air stream generated below the surface 3 to strike said first layer.

The first layer 13 is provided with two side walls 15 for containing the mixture layer 5, which protrude upward from said first layer and are arranged parallel to the advancement direction A.

In the particular embodiment shown in FIG. 1, the surface 3 is formed by the active portion of a conventional continuous belt conveyor 16.

The first layer 13 and the second layer 14 are closed in a loop; the second layer 14 winds around two pulleys 17, a driving pulley and a driven pulley, which are supported so that they can rotate about respective horizontal rotation axes by the framework 2, while the first layer 13 winds around the second layer 14 so as to constitute said belt.

Figure 3:
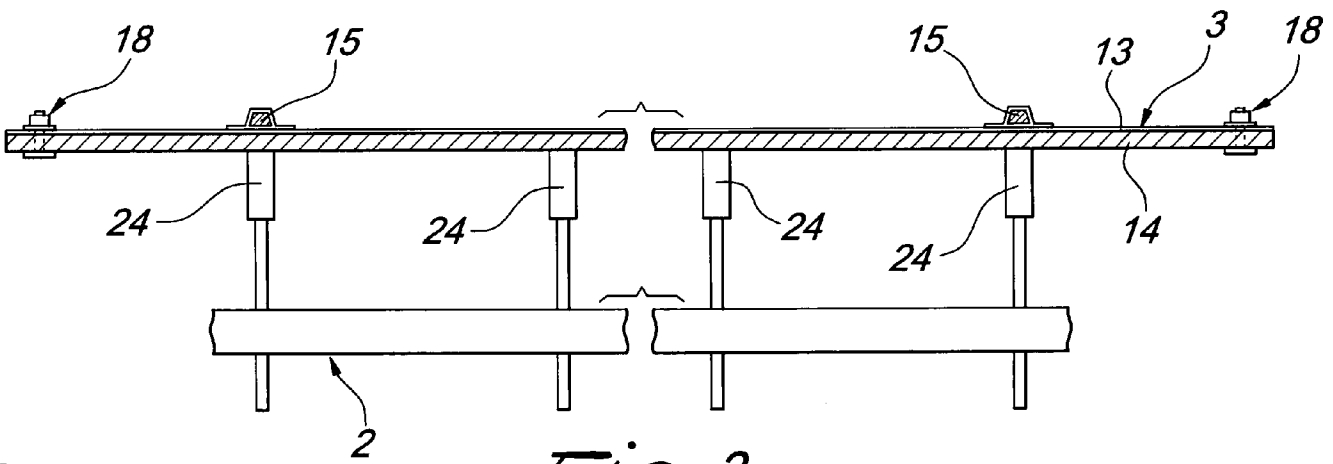
FIG. 3 is a transverse sectional view of a first embodiment of the transfer surface of the apparatus according to the invention.

In a first embodiment of the surface 3, shown in FIG. 3, the first layer 13 and the second layer 14 are mutually coupled by way of interposed coupling means 18 and the pulleys 17 actuate the simultaneous advancement of both layers 13 and 14.

The coupling means 18 are constituted for example by connection elements of the threaded or pressure-based type or the like, which are distributed along the lateral and superimposed edges of the layers 13 and 14.

The means for actuating the first layer 13 and the second layer 14 along the advancement direction A mutually coincide and are constituted by the pulleys 17.

In this case, the first layer 13 must be made of a material that is elastic enough to compensate for the different expansion of said first layer with respect to the second layer 14 at the pulleys 17.

Figure 4:
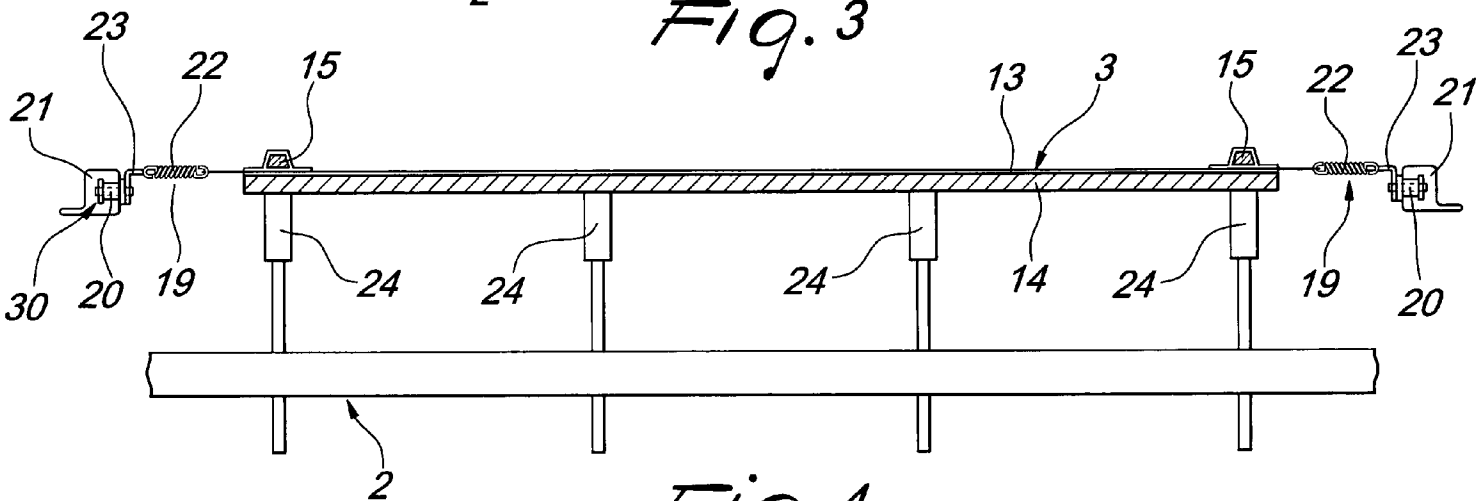
FIG. 4 is a transverse sectional view of a second embodiment of the transfer surface of the apparatus according to the invention.

In a second embodiment of the surface 3, shown in FIG. 4, the apparatus 1 comprises first and second actuation means, which are separate but synchronized, for the advancement of the first layer 13 and of the second layer 14 respectively.

Conveniently, there are conventional means 31 such as suitable mechanical means provided at pulleys 17 for synchronizing the advancement of the first and second layers 13 and 14 in order to avoid their mutual slippage.

The apparatus 1 further has means 19 for tensioning the first layer 13.

The first actuation means are constituted by two flexible elements 20, which are constituted by respective chains that are closed in a loop and wound around respective pairs of driving and driven sprockets or pulleys 30, which are supported, so that they can rotate about respective horizontal axes, by the framework 2.

The flexible elements 20 are arranged on opposite sides of the surface 3 and are associated with the first layer 13 by interposing tensioning means 19.

The flexible elements 20 are supported so that they can slide within respective guiding profiles 21 that are associated with the framework 2.

The tensioning means 19 comprise elastic traction means constituted by a plurality of springs 22 that are distributed along the lateral edges of the first layer 13.

The first layer 13 protrudes laterally from the second layer 14 and has a plurality of slots, not shown in the figures, which are distributed along the corresponding lateral edges and in which the hook-like ends of respective springs 22 are inserted, the opposite ends of said springs being inserted in corresponding openings, not shown in the figures, formed in brackets 23 that are fixed to the flexible elements 20.

In this case, the second actuation means are instead constituted by two pulleys, not shown in the figures, around which the second layer 14 is wound in a loop.

The framework 2 further comprises supports 24, which are arranged below the surface 3 and slidingly support the second layer 14.

In a second embodiment, shown in FIG. 5, the apparatus 1 has means 25 for vibrating at least the first layer 13, which are arranged below the surface 3 and proximate to the deposition unit 4 so as to achieve uniform distribution of the layer 5 on said surface as well as homogenization of said layer.

The action of the vibrating means 25, moreover, facilitates the elimination of any air bubbles retained by the slurry, improving the quality of the strand 7 obtained by drying.

The vibrating means 25 are preferably interposed between the deposition unit 4 and the drying unit 6 and can be constituted for example by a vibrating surface of the mechanically-actuated, ultrasonic or other type, which is tangent below the first layer 13.

Figure 5:
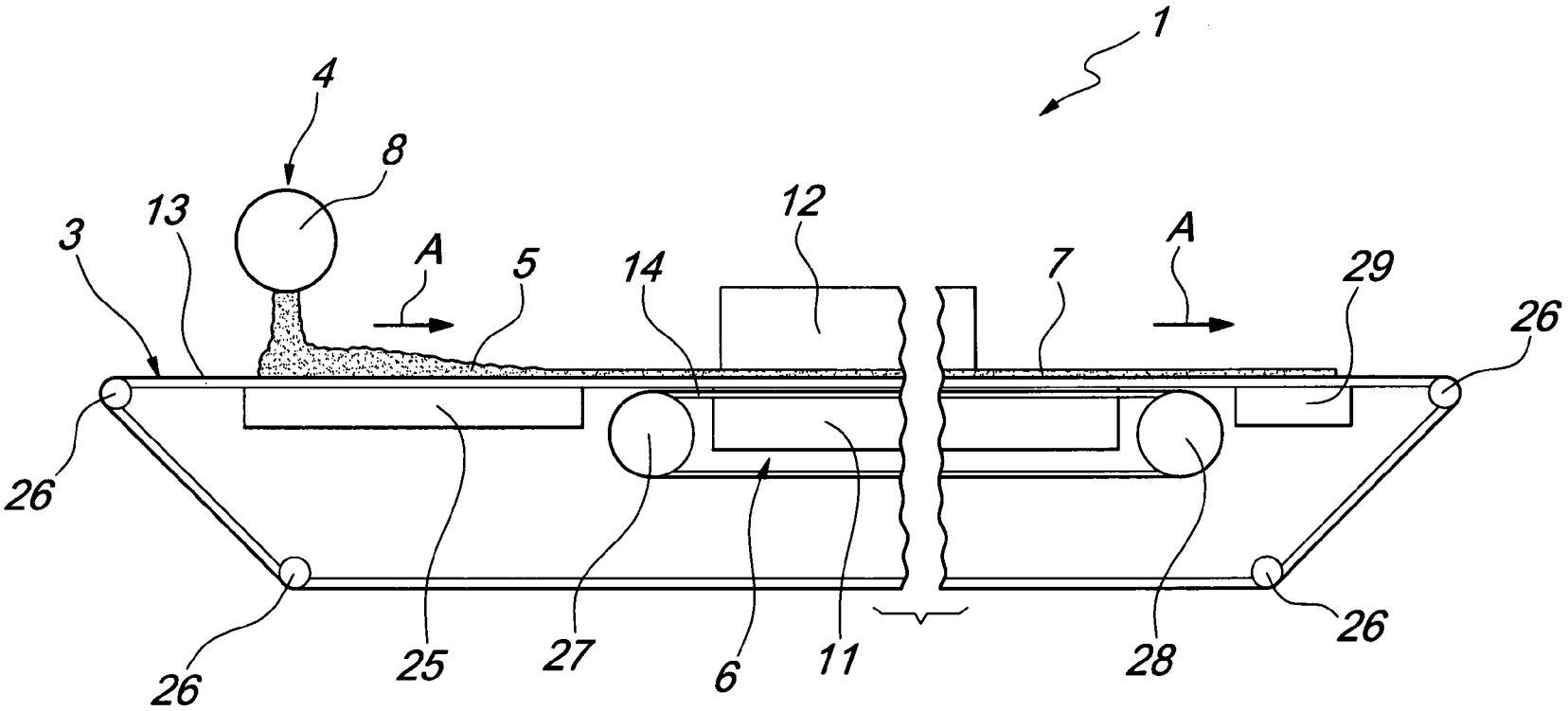
FIG. 5 is a partial schematic side view of a second embodiment of the apparatus for performing the method according to the invention.

The apparatus 1 shown in FIG. 5 does not have the leveling unit 9 described above, but as an alternative said unit can be provided.

The first and second actuation means are separate but synchronized, since said synchronization means are interposed so as to avoid mutual slippage between the layers 13 and 14.

The first actuation means comprise a plurality of first pulleys 26, at least one of which is a driving pulley, around which the first layer 13 is wound in a loop.

The active portion of the second layer 14 is tangent in a lower region with respect to the active portion of the first layer 13, so as to support it at least at the drying unit 6.

The second actuation means comprise a second driving pulley 27 and a second driven pulley 28, around which the second layer 14 is wound in a loop, said pulleys being arranged inside the loop formed by the first layer 13.

Downstream of the second layer 14 there is a connecting surface 29 that supports the end portion of the first layer 13.

If there are a plurality of deposition units 4, it is possible to provide a plurality of vibrating means 25 arranged at respective deposition units 4.

The method according to the invention, performed with the aid of the apparatus 1, comprises at least one step for depositing by pouring at least one layer 5 of a ceramic mixture that comprises an aqueous vehicle on the surface 3; at least one step for drying the lower portion of the surface 3 at the layer 5, so as to achieve at least partial evaporation of the aqueous vehicle absorbed by said surface, with consequent at least partial drying of the layer 5 to obtain a continuous strand 7 of plastic ceramic material; and a step for cutting said strand 7 in order to obtain a plurality of ceramic articles having the chosen dimensions.

The method according to the invention may further provide for a step for separating the strand 7 from the surface 3 and for transferring said strand onto an auxiliary working surface, not shown in the figures, said step being performed ahead of the cutting step.

The drying step consists in generating a stream of forced air below the surface 3 and preferably in applying heat to the lower side of the surface 3 by conduction or convection or radiation.

Drying of the surface 3 occurs in a controlled manner, so that the strand 7 retains a residual humidity that gives it the plasticity required to perform the separation and cutting steps.

The method according to the invention further comprises at least one step for leveling the deposited layer 5.

As an alternative to the leveling step, or as an addition thereto, the method according to the invention can provide for a step for vibrating the deposited layer.

In an alternative embodiment, the method provides for the execution of a plurality of successive steps for depositing respective layers 5, the first layer 5 being deposited on the surface 3 and each successive layer 5 being deposited on the previously deposited layer 5.

In this case, after one or more deposition steps it is possible to provide a step for leveling the thickness of the deposited layer 5 and/or a step for vibrating each deposited layer 5.

In the method according to the invention, the step for drying the surface 3 can be performed simultaneously with the deposition step or after said deposition step.

It is then possible to provide a step for glazing and/or decorating the last deposited layer 5 and a step for rolling the strand 7, performed before the cutting step.

The resulting articles then follow the conventional production process, which substantially consists of drying, firing, sorting and packing.

In practice it has been found that the described invention achieves the proposed aim and object.

The invention thus conceived is susceptible of numerous modifications and variations, all of which are within the scope of the appended claims.

All the details may further be replaced with other technically equivalent ones.

In practice, the materials used, as well as the shapes and the dimensions, may be any according to requirements without thereby abandoning the scope of the protection of the appended claims.

The disclosures in Italian Patent Application No. MO2003A000174 from which this application claims priority are incorporated herein by reference.

What is claimed is:

1. An apparatus for forming substantially plate-shaped ceramic articles, comprising:

a framework for supporting a substantially absorbent transfer surface;

at least one deposition unit for depositing by pouring at least one mixture layer of a ceramic mixture that comprises an aqueous vehicle on said surface;

at least one drying unit for drying at least a lower portion of said surface so as to achieve at least a partial evaporation of the aqueous vehicle absorbed by said surface, with consequent at least partial drying of said mixture layer in order to obtain a continuous strand of plastic ceramic material; and a cutting unit for cutting said strand into a plurality of ceramic articles;

said transfer surface comprising at least one first layer made of a material adapted to substantially absorb said aqueous vehicle, and at least one second layer for supporting said first layer, which is arranged below said first layer and is constituted by a material that is substantially permeable to air, the apparatus further comprising first and second synchronized actuation means for actuating advancement of said first and second layers respectively.

2. The apparatus of claim 1, wherein said absorbent material is constituted by textile fibers constituted by cotton or any other fiber adapted to absorb aqueous substances.

3. The apparatus of claim 1, wherein said second layer is constituted by a material with heat-conducting properties.

4. The apparatus of claim 3, wherein said second layer is constituted by a metal mesh constituted by a plurality of mutually articulated links.

5. The apparatus of claim 1, wherein said first layer comprises at least one pair of side walls for containing said mixture layer.

6. The apparatus of claim 1, comprising tensioning means for tensioning said first layer.

7. The apparatus of claim 6, wherein said tensioning means comprises elastic traction means.

8. The apparatus of claim 1, wherein said surface is formed by an active portion of a continuous belt conveyor.

9. The apparatus of claim 8, comprising two pulleys, a driving pulley and a driven pulley, which are rotatably supported by said framework, said first and second layers being closed in a loop, with the second layer being wound around said pulleys, the first layer being wound around said second layer so as to constitute said belt.

10. The apparatus of claim 9, wherein said first actuation means are constituted by two flexible elements, which are closed in a loop and wound around respective pairs of said pulleys that are rotatably supported by said framework, said flexible elements being arranged laterally to said first layer and being associated with said first layer by interposing said tensioning means.

11. The apparatus of claim 1, comprising at least one leveling unit for leveling said deposited mixture layer, which is arranged on said surface downstream of said deposition unit along an advancement direction of said surface.

12. The apparatus of claim 11, wherein said leveling unit comprises at least one leveling blade, which is arranged above said surface and transversely to the advancement direction of said surface.

13. The apparatus of claim 12, wherein said deposition unit comprises a tubular body, which is arranged above said surface and lies substantially transversely with respect to the advancement direction of said surface and is provided in a lower region with a plurality of holes for dispensing said mixture, and with a pump for feeding said mixture toward said tubular body.

14. The apparatus of claim 13, comprising vibrating means for vibrating at least said first layer, said vibrating means being arranged at least at said deposition unit.

15. The apparatus of claim 14, wherein said drying unit comprises ventilation means, which cooperate with a lower portion of said surface.

16. The apparatus of claim 15, wherein said drying unit comprises heat generation means that cooperate with the lower portion of said surface.

17. The apparatus of claim 16, wherein said drying unit comprises at least one chamber for containing a portion of said surface, said chamber being arranged above said surface downstream of said deposition unit along the advancement direction of said surface.

18. The apparatus of claim 1, comprising a plurality of said deposition units distributed along said surface.

19. The apparatus of claim 18, further comprising a plurality of leveling units arranged downstream of respective deposition units.

20. The apparatus of claim 19, further comprising a plurality of vibrating units for vibrating at least said first layer, each arranged downstream of a respective deposition unit.

* * * * *